US010096421B2

(12) United States Patent
Iwakura et al.

(10) Patent No.: US 10,096,421 B2
(45) Date of Patent: Oct. 9, 2018

(54) COIL DEVICE AND METHOD FOR MANUFACTURING THE SAME

(71) Applicant: TDK CORPORATION, Minato-ku, Tokyo (JP)

(72) Inventors: Masaaki Iwakura, Tokyo (JP); Katsuhiro Ishigaki, Tokyo (JP); Hiroshi Maeda, Tokyo (JP); Satoshi Shinbo, Tokyo (JP); Nobuo Kitajima, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/683,157

(22) Filed: Aug. 22, 2017

(65) Prior Publication Data

US 2017/0352474 A1 Dec. 7, 2017

Related U.S. Application Data

(62) Division of application No. 15/076,227, filed on Mar. 21, 2016, now Pat. No. 9,793,044.

(30) Foreign Application Priority Data

Mar. 31, 2015 (JP) ..... 2015-071600

(51) Int. Cl.
*H01F 7/06* (2006.01)
*H01F 27/32* (2006.01)
(Continued)

(52) U.S. Cl.
CPC ..... *H01F 27/325* (2013.01); *H01F 5/02* (2013.01); *H01F 27/2823* (2013.01); *H01F 2005/022* (2013.01)

(58) Field of Classification Search
CPC ..... H01F 5/02; H01F 41/06; H01F 27/2823; H01F 27/325
See application file for complete search history.

(56) References Cited

U.S. PATENT DOCUMENTS 6,311,912 B1 * 11/2001 Chang ..... B65H 75/146 112/279
6,449,178 B1 * 9/2002 Sakai ..... H01F 27/324 363/131
(Continued)

FOREIGN PATENT DOCUMENTS

CN 101950656 A 1/2011
JP H05-048313 A 2/1993
(Continued)

OTHER PUBLICATIONS

Chinese Office Action of related Chinese Patent Application No. 201610191154.2 dated Jun. 28, 2017.
(Continued)

*Primary Examiner* — Paul D Kim
(74) *Attorney, Agent, or Firm* — Arent Fox LLP

(57) ABSTRACT

A coil device includes a bobbin, a first winding part, and a second winding part. A partition portion is formed on an outer peripheral surface of the bobbin. The first winding part is wound around the outer peripheral surface at one side of the partition portion. The second winding part is wound around the outer peripheral surface at the other side of the partition portion and has an inner winding layer and an outer winding layer located farther to the outer peripheral surface at the other side than the inner winding layer.

5 Claims, 4 Drawing Sheets

(51) Int. Cl.
*H01F 27/28* (2006.01)
*H01F 5/02* (2006.01)

(56) References Cited

U.S. PATENT DOCUMENTS 7,236,077 B1 * 6/2007 Hsu ..... H01F 27/326 336/180
7,535,331 B2 * 5/2009 Sakai ..... H01F 27/325 336/208
7,724,115 B2 * 5/2010 Chen ..... H01F 27/326 336/131
7,830,234 B1 * 11/2010 Tien ..... H01F 27/326 336/192
8,058,962 B2 11/2011 Zeng et al.
9,899,139 B2 * 2/2018 Li ..... H01F 5/04
2002/0017975 A1 * 2/2002 Chiang ..... H01F 5/02 336/198
2007/0216508 A1 9/2007 Ger et al.
2009/0237195 A1 9/2009 Zeng et al.
2009/0278646 A1 * 11/2009 Chen ..... H01F 27/325 336/177
2010/0231343 A1 9/2010 Zeng et al.
2011/0043315 A1 * 2/2011 Kobayashi ..... H01F 27/2828 336/192
2012/0106207 A1 * 5/2012 Tsai ..... H01F 27/324 363/21.02
2013/0169400 A1 * 7/2013 Kim ..... H01F 27/2823 336/192

FOREIGN PATENT DOCUMENTS

JP 2009-021558 A 1/2009
JP 2012-099590 A 5/2012
JP 2012-248610 A 12/2012

OTHER PUBLICATIONS

Korean Office Action of related Korean Patent Application No. 10-2016-0033518 dated Jun. 14, 2017.

* cited by examiner

COIL DEVICE AND METHOD FOR MANUFACTURING THE SAME

This is a division of U.S. application Ser. No. 15/076,227 filed on Mar. 21, 2016, now U.S. Pat. No. 9,793,044.

BACKGROUND OF THE INVENTION

1. Field of the Invention

The present invention relates to a coil device or so, and more specifically relates to a coil device or so favorably used as a high voltage transformer and wound by a plurality of winding parts.

2. Description of the Related Art

A coil device with a partition portion on its outer peripheral surface of a bobbin where a primary coil is formed at one side of the partition portion and a secondary coil is formed at the other side thereof is proposed (see Patent Document 1). Such a coil device has an advantageous structure for thinning (low profile), and is thus in demand for transformers used for electronic appliances, such as television, transformers for vehicle mounted on automobiles, and the like.

Patent Document 1: Japanese Unexamined Utility Model Application Publication No. 5-48313

SUMMARY OF THE INVENTION

However, in the high voltage transformers where a large electric current flows on a secondary side, the following problem arises: When using a wire whose diameter is large to reduce DC resistance on a secondary coil, an occupation rate is decreased due to a larger wire space, and the transformers are hard to be smaller.

The present invention has been achieved in consideration of the circumstances. It is an object of the invention to provide a coil device having a high occupation rate and saving space.

To achieve the object, the coil device according to the present invention comprises:

a bobbin whose outer peripheral surface includes a partition portion;

a first winding part wound around the outer peripheral surface at one side of the partition portion; and a second winding part wound around the outer peripheral surface at the other side of the partition portion and having an inner winding layer and an outer winding layer located farther to the outer peripheral surface at the other side than the inner winding layer, wherein the second winding part includes a first wire part and a second wire part that are wound to be adjacent to each other in a winding axis direction, one of the first wire part and the second wire part is arranged nearer to the first winding part than the other wire part in the inner winding layer, and the other wire part of the first wire part and the second wire part is arranged nearer to the first winding part than the one wire part in the outer winding layer.

In the coil device according to the invention, the second winding part has a winding structure where the first wire part and the second wire part are wound to be adjacent to each other in the winding axis direction. In this winding structure, an electric current of the second winding part flows separately through the first wire part and the second wire part. Thus, the coil device according to the invention can reduce diameter of each wire part in the second wire part, improve an occupation rate of the second winding part, and achieve space saving.

Further, in the coil device according to the invention, one of the first wire part and the second wire part is arranged nearer to the first winding part than other wire part in the inner winding layer, and the outer winding layer is contrary to the inner winding layer. In this arrangement, magnetic coupling to the first winding part can be adjusted between the first wire part and the second wire part. Thus, the coil device according to the invention can prevent an electric current from flowing in a biased manner through one of the wire parts and prevent heat generation and energy loss caused by a large electric current flow through some of the wire part. Also, when the first wire part and the second wire part are connected through a terminal or a mounting board, a circulating electric current occurs between the first wire part and the second wire part if magnetic coupling to the first winding part is biased between the respective wire parts. The coil device according to the invention can prevent generation of such a circulating electric current and prevent heat generation and energy loss caused by generation of the circulating electric current.

Also, the first wire part of the outer winding layer may be arranged nearer to the second wire part of the inner winding layer than the second wire part of the outer winding layer.

In this configuration, magnetic coupling to the first winding part can be adjusted more uniformly between the first wire part and the second wire part.

In view of enhancing magnetic coupling between the first winding part and the second winding part, the coil device according to the present invention preferably comprises a core arranged inside the bobbin.

A method for manufacturing the coil device according to the present invention comprises the steps of:

preparing a bobbin whose outer peripheral surface includes a partition portion; forming a first winding part on the outer peripheral surface at one side of the partition portion;

forming an inner winding layer of a second winding part by winding a wire bundle with a first wire part and a second wire part around the outer peripheral surface at the other side of the partition portion so that the first wire part and the second wire part are adjacent to each other in a winding axis direction, and forming an outer winding layer of the second winding part by winding the wire bundle around an outside of the inner winding layer so that the first wire part and the second wire part are adjacent to each other in the winding axis direction, wherein the wire bundle is twisted to change a positional relation between the first wire part and the second wire part.

This manufacturing method can obtain the coil device having a high occupation rate and saving space.

DESCRIPTION OF THE PREFERRED EMBODIMENTS

Hereinafter, the present invention will be explained based on an embodiment shown in the figures.

Figure 1:
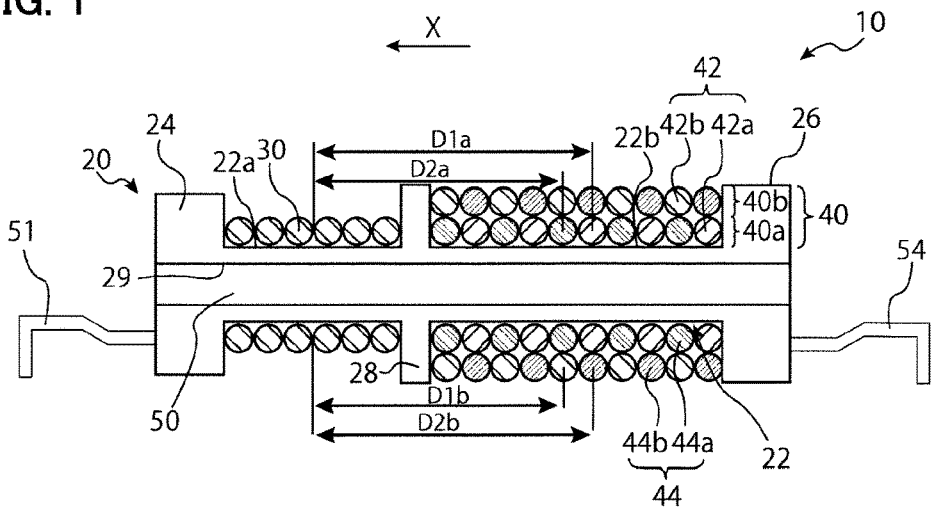
FIG. 1 is a cross section showing a coil device according to one embodiment of the present invention.

FIG. 1 is a cross section showing a coil device 10 according to one embodiment of the present invention. The coil device 10 has a bobbin 20, a first winding part 30, a second winding part 40, terminals 51 to 56, and a core 50. The present invention is directed to the horizontal-type coil device 10 mounted on a board through the terminals 51 to 56 provided at both ends of the bobbin 20, but the coil device according to the present invention is not limited to this shape and may be applied to a vertical-type coil device.

The bobbin 20 has a hollow cylindrical outer shape where a hollow part 29 for arranging a core 50 is formed inside. An outer peripheral surface 22 and the hollow cylindrical part 29 of the bobbin 20 extend in a winding axis direction X of the first winding part 30 and the second winding part 40. Also, protrusions protruding in the outer diameter direction are formed at three parts of the outer peripheral surface 22 of the core 50. A first flange 24 is formed at one of ends of the core 50, and a second flange 26 is formed at the other end of the core 50. Further, a partition portion 28 is formed between the first flange 24 and the second flange 26 on the outer peripheral surface 22 of the core 50.

The outer peripheral surface 22 is divided into a first outer peripheral surface 22*a* and a second outer peripheral surface 22*b*. The first outer peripheral surface 22*a* is the outer peripheral surface 22 at one side of the partition portion 28 and is wound by the first winding part 30. The second outer peripheral surface 22*b* is the outer peripheral surface 22 at the other side of the partition portion 28 and is wound by the second winding part 40. As is the case with the first flange 24 and the second flange 26, the partition portion 28 has a flange shape continued in the outer peripheral direction. The partition portion 28, however, has any shape that can divide the outer peripheral surface 22 to separately wind the first and second winding parts 30 and 40 around the first and second outer peripheral surfaces 22*a* and 22*b*. For example, the partition portion 28 may be made of a protrusion formed intermittently in the outer peripheral direction.

The first winding part 30 is wound around the first outer peripheral surface 22*a* continued from the partition portion 28 to the first flange 24. The first winding part 30 has any winding number, and may be wound around the first outer peripheral surface 22*a* by only single layer or multiple layers like the second winding part 40 shown in FIG. 1. The first winding part 30 consists of one wire part, but may consist of multiple wire parts as with the second winding part 40 mentioned below. Note that, although not shown in FIG. 1, ends of the first winding part 30 are connected to the terminals 51 and 52 (see FIG. 2 and FIG. 3) provided at the first flange 24 of the bobbin 20.

The second winding part 40 is wound around the second outer peripheral surface 22*b* continued from the partition portion 28 to the second flange 26. The second winding part 40 is formed by doubly winding first and second wire parts 42 and 44 mentioned below around the second outer peripheral surface 22*b*, and has an inner winding layer 40*a* and an outer winding layer 40*b*. The inner winding layer 40*a* of the second winding part 40 is directly wound around the second outer peripheral surface 22*b*, and the outer winding layer 40*b* is wound around the inner winding layer 40*a*. Thus, the outer winding layer 40*b* is located father toward the second outer peripheral surface 22*b* than the inner winding layer 40*a*.

As shown in FIG. 1, the second winding part 40 has the first and second wire parts 42 and 44 that are wound to be adjacent to each other in the winding axis direction X, which is also a direction along the second outer peripheral surface 22*b*. The first and second wire parts 42 and 44 are wires coated with insulation and are insulated each other at least where they are wound around the second outer peripheral surface 22*b*.

The inner winding layer 40*a* of the second winding part 40 consists of an inner winding layer first wire part 42*a* of the first wire part 42 in the inner winding layer 40*a* and an inner winding layer second wire part 44*a* of the second wire part 44 in the inner winding layer 40*a*. Both of the inner winding layer first wire part 42*a* and the inner winding layer second wire part 44*a* have a spiral shape along the second outer peripheral surface 22*b*. Thus, the inner winding layer first wire part 42*a* and the inner winding layer second wire part 44*a* are arranged so that one of these wire parts passes through spiral space of the other wire part.

Also, the outer winding layer 40*b* of the second winding part 40 consists of an outer winding layer first wire part 42*b* of the first wire part 42 in the outer winding layer 40*b* and an outer winding layer second wire part 44*b* of the second wire part 44 in the outer winding layer 40*b*. Both of the outer winding layer first wire part 42*b* and the outer winding layer second wire part 44*b* have a spiral shape along the outer surface of the inner winding layer 40*a*. The outer winding layer 40*b* has the same structure as the inner winding layer 40*a*. The outer winding layer first wire part 42*b* and the outer winding layer second wire part 44*b* are arranged so that one of these wire parts passes through spiral space of the other wire part.

In the inner winding layer 40*a*, the second wire part 44 out of the first wire part 42 and the second wire part 44 is arranged nearer to the first winding part 30 than the first wire part 42 when comparing them by distances D1*a* and D2*a* between the centers of each part (see FIG. 1). On the other hand, in the outer winding layer 40*b*, the first wire part 42 out of the first wire part 42 and the second wire part 44 is arranged nearer to the first winding part 30 than the second wire part 44 when comparing them by distances D1*b* and D2*b* between the centers of each part (see FIG. 1). That is, with respect to the second winding part 40, one of the first wire part 42 and the second wire part 44 is located nearer to the first winding part 30 than the other wire part in the inner winding layer 40*a*, and the other wire part of the first wire part 42 and the second wire part 44 is located nearer to the first winding part 30 than the one wire part in the outer winding layer 40*b*. Note that, the first wire part 42 and the second wire part 44 may be arranged interchangeably.

As shown in FIG. 1 showing a cross section extending along the winding axis direction X, the inner winding layer 40*a* is arranged in the order of the second wire part 44, the first wire part 42, the second wire part 44, the first wire part 42, . . . toward a direction going away from the partition portion 28 along the winding axis direction X. On the other hand, the outer winding layer 40*b* is arranged in the order of the first wire part 42, the second wire part 44, the first wire part 42, the second wire part 44, . . . toward a direction going away from the partition portion 28 along the winding axis direction X. In this way, the first wire part 42 and the second wire part 44 are arranged in a switched manner between the inner winding layer 40*a* and the outer winding layer 40*b*. Thus, the outer winding layer first wire part 42*b* is arranged nearer to the inner winding layer second wire part 44*a* than the outer winding layer second wire part 44*b*.

Note that, the second winding part 40 can be made in the following manner. A wire bundle 46 (FIG. 5A) where the second wire part 44 is arranged nearer to the partition portion 28 than the first wire part 42 is wound around the bobbin 20 to form the inner winding layer 40*a*, and on the contrary, the wire bundle 46 (FIG. 5B) where the first wire part 42 is arranged nearer to the partition portion 28 than the second wire part 44 is wound around the bobbin 20 to form the outer winding layer 40*b*. The method for forming the second winding part 40 will be explained in detail later.

The magnetic core 50 is arranged in the hollow part 29 of the bobbin 20. The terminals 51 and 52 are provided at the first flange 24, and the terminals 53, 54, 55, and 56 are provided at the second flange 26. For example, the coil device 10 is mounted by soldering the terminals 51 to 56 onto a mounting board and is used as a transformer or so.

Figure 2:
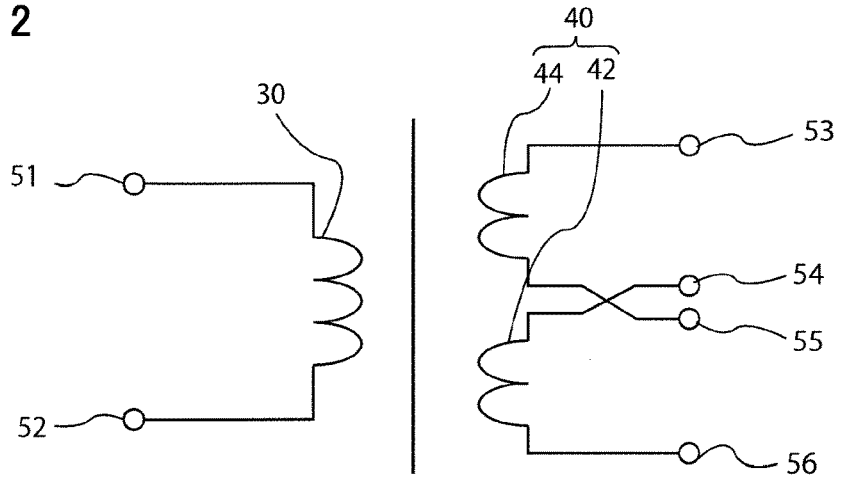
FIG. 2 is a circuit diagram of the coil device shown in FIG. 1.

FIG. 2 is a circuit diagram of the coil device 10. Both ends of the first winding part 30 are connected to the terminal 51 and the terminal 52. On the other hand, both ends of the first wire part 42 of the second winding part 40 are connected to the terminal 54 and the terminal 56, and both ends of the second wire part 44 of the second winding part 40 are connected to the terminal 53 and the terminal 55, which are different from ones to which the ends of the first wire part 42 are connected. In this configuration, for example, when a primary electric current flows through the first winding part 30, the wire parts 42 and 44 can respectively extract output by an induced electric current generated at the first wire part 42 and the second wire part 44.

Figure 3:
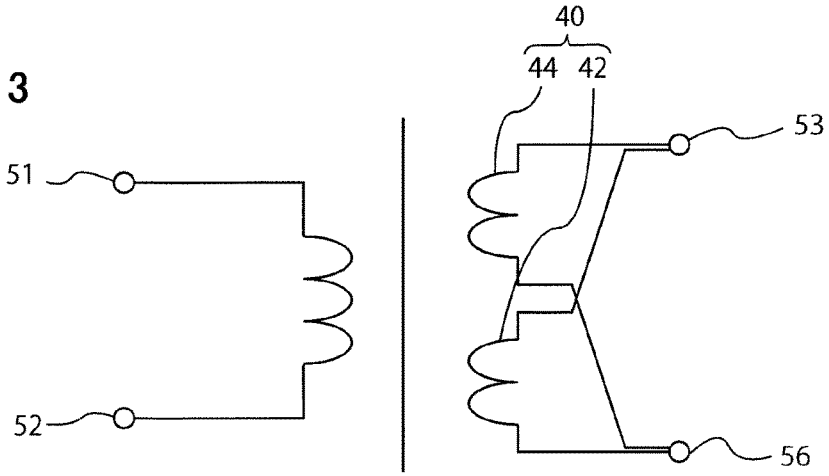
FIG. 3 is a circuit diagram of a coil device according to a variation.

The first wire part 42 and the second wire part 44 are not limited to connect to the terminals in this way. For example, FIG. 3 is a circuit diagram of the coil device 10 according to a variation. This variation is different from the coil device 10 shown in FIG. 2 in that both the ends of the first wire part 42 and the ends of the second wire part 44 are connected to the terminal 53 and the terminal 56. This variation demonstrates the same effect as the coil device 10 shown in FIG. 2 except that output of the wire parts 42 and 44 is extracted together.

The bobbin 20 of the coil device 10 is made of any material, but is preferably made of insulation material, such as resin, and particularly preferably made of phenol resin in view of heat resistance or so, for example. The core 50 is made of any magnetic body and is manufactured by performing pressure molding or so to ferrite particles or metal particles, including Fe—Ni alloy powder, Fe—Si alloy powder, Fe—Si—Cr alloy powder, Fe—Si—Al alloy powder, permalloy powder, amorphous powder, or Fe powder.

The wire part of the first winding part 30 and the first and second wire parts 42 and 44 of the second winding part 40 are any coated wire made by coating a conductor with insulation. This conductor may consist of one wire (single wire) or a bundle of a plurality of wires, such as stranded wire, and may be made of copper, silver, gold, alloy thereof, or the like. The wire part of the first winding part 30 and both ends of the first and second wire parts 42 and 44 of the second winding part 40 are connected to the terminals 51 to 56 by laser welding, resistance welding, soldering, or the like.

The coil device 10 can be manufactured by the following steps, for example. First, the bobbin 20 with the partition portion 28 as shown in FIG. 1 formed around the outer peripheral surface 22 is prepared. The bobbin 20 is made by resin molding, for example. Preferably, the terminals 51 to 56 (see FIGS. 5A and 5B) are provided at both ends of the bobbin 20.

Next, the second winding part 44 is formed around the second outer peripheral surface 22*b*, which is the outer peripheral surface 22 at the other side of the partition portion 28. Note that, the second winding part 40 may be formed after forming the first winding part 30 around the first outer peripheral surface 22*a*, which is the outer peripheral surface 22 at the one side of the partition portion 28. FIGS. 4A and 4B and FIGS. 5A and 5B are conceptual figures showing steps for forming the second winding part 40.

Figure 4A:
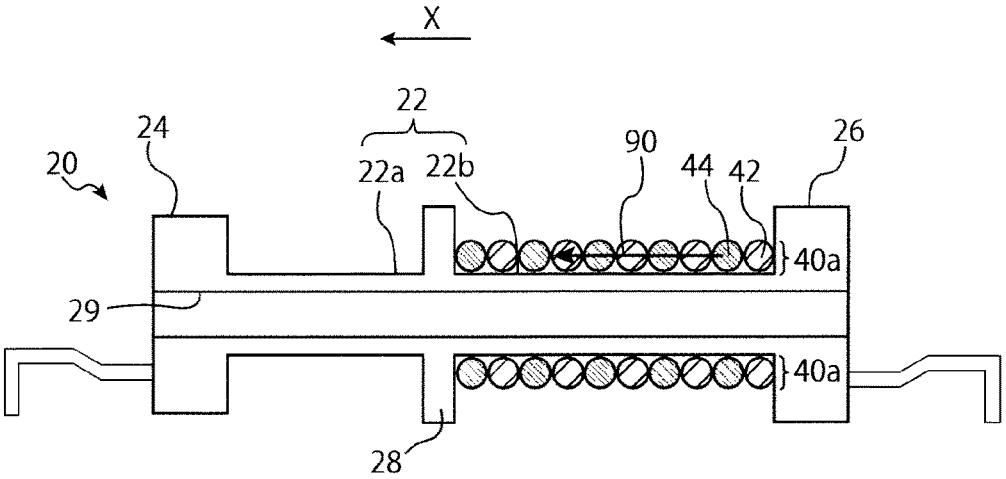
FIG. 4A is a schematic cross section showing a method for manufacturing a coil device.
Figure 4B:
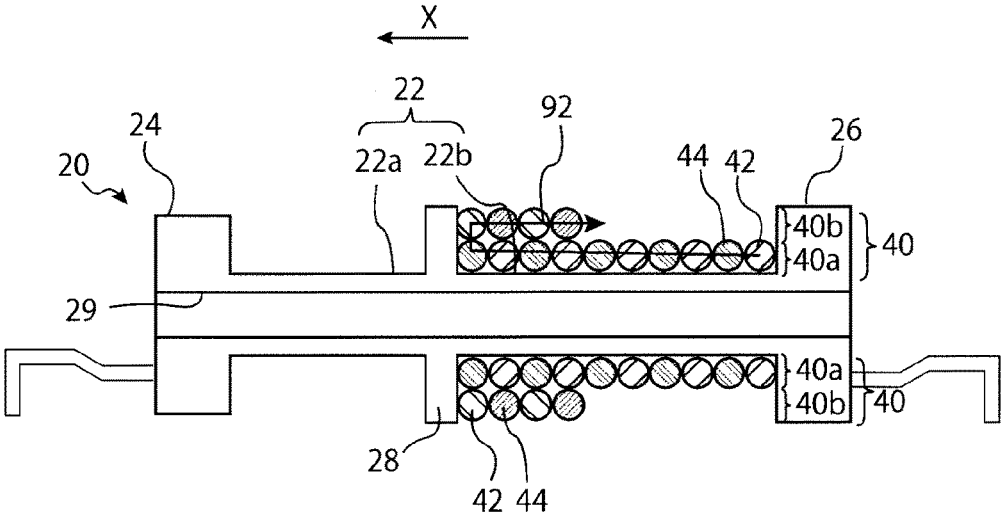
FIG. 4B is a schematic cross section showing a method for manufacturing a coil device.

As shown in FIG. 4A, the inner winding layer 40*a* of the second winding part 40 is firstly formed in the steps for forming the second winding part 40.

Figure 5A:
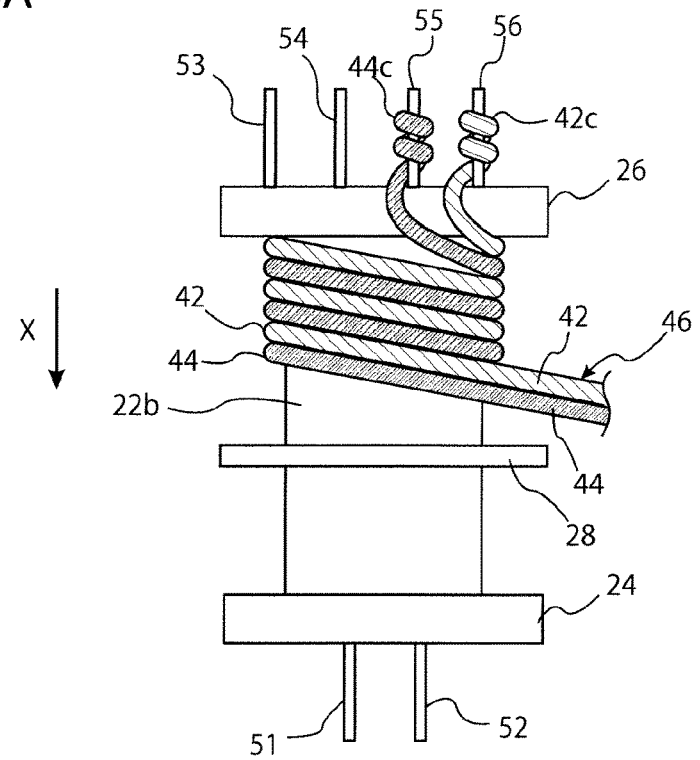
FIG. 5A is a schematic plane view showing a method for manufacturing a coil device.

As shown in FIG. 5A, the inner winding layer 40*a* is formed by winding the wire bundle 46 with the first and second wire parts 42 and 44 so that the first and second wire parts 42 and 44 are adjacent to each other in the winding axis direction X. In the step for forming the inner winding layer 40*a*, as shown by an arrow 90 in FIG. 4A, the wire bundle 46 starts being wound from the second flange 26 toward the partition portion 28.

In an example shown in FIG. 5A, a tip 42*c* of the first wire part 42 is temporarily connected to the terminal 56, and a tip 44*c* of the second wire part 44 is temporarily connected to the terminal 55. Note that, the wire bundle 46 may include a wire part except for the first wire part 42 and the second wire part 44, and that the number of the wire parts included by the wire bundle 46 is not limited to two and may be three, four, or five or more.

Figure 5B:
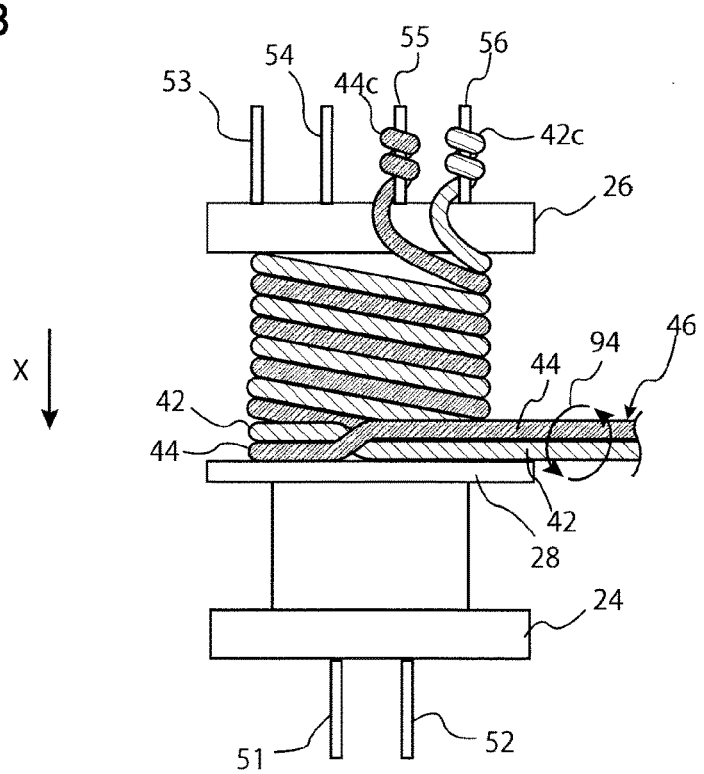
FIG. 5B is a schematic plane view showing a method for manufacturing a coil device.

After forming the inner winding layer 40 by winding the first and second wire parts 42 and 44 to the partition portion 28, as shown by arrows 94 in FIG. 5B, the wire bundle 46 is twisted by 180 degrees to change a positional relation between the first wire part 42 and the second wire part 44. That is, with respect to the wire bundle 46 while forming the inner winding layer 40*a*, as shown in FIG. 5A, the second wire 44 is located nearer to the partition portion 28 than the first wire part 42. On the other hand, with respect to the wire bundle 46 while forming the outer winding layer 40*b*, as shown in FIG. 5B, the first wire part 42 is located nearer to the partition portion 28 than the second wire part 44.

The outer winding layer 40*b* is formed by winding the wire bundle 46 whose positional relation is changed as shown in FIG. 5B around the outside of the inner winding layer 40*a* so that the first wire part 42 and the second wire part 44 are adjacent to each other in the winding axis direction X. In the step for forming the outer winding layer 40*b*, as shown by an arrow 92 in FIG. 4B, the wire bundle 46 starts being wound from the partition portion 28 toward the second flange 26 in an opposite manner to the step for forming the inner winding layer 40*a*. When the wire bundle 46 is wound to the second flange 26, a rear end of the first wire part 42 is temporarily connected to the terminal 54, and a rear end of the second wire part 44 is temporarily connected to the terminal 53.

After forming the second winding part 40 around the second outer peripheral surface 22*b*, the first winding part 30 is formed around the first outer peripheral surface 22*a*. The first winding part 30 is formed by proceeding to wind one wire part from the first flange 24 toward the partition portion 28. Both ends of the first winding part 30 are temporarily fixed to the terminal 51 and the terminal 52. After completion of winding the first winding part 30 and the second winding part 40, the ends of the wire parts and the terminals 51 to 56 are fixed by welding, soldering, or the like.

The coil device 10 shown in FIG. 1 is obtained by inserting the core 50 into the hollow part 29 of the bobbin 20 after forming the first and second winding parts 30 and 40 around the bobbin 20 as mentioned above. Note that, an insulation tape may be wound around the outside of the first and second winding parts 30 and 40.

In the coil device 10 according to the present embodiment, the second winding part 40 has a winding structure where the first wire part 42 and the second wire part 44 are wound to be adjacent to each other in the winding axis direction, and the electric current of the second winding part 40 flows separately through the first wire part 42 and the second wire part 44. Thus, it is possible to reduce diameters of the respective wire parts 42 and 44 in the second winding part 40, improve an occupation rate of the second winding part 40, and achieve space saving.

Figure 6:
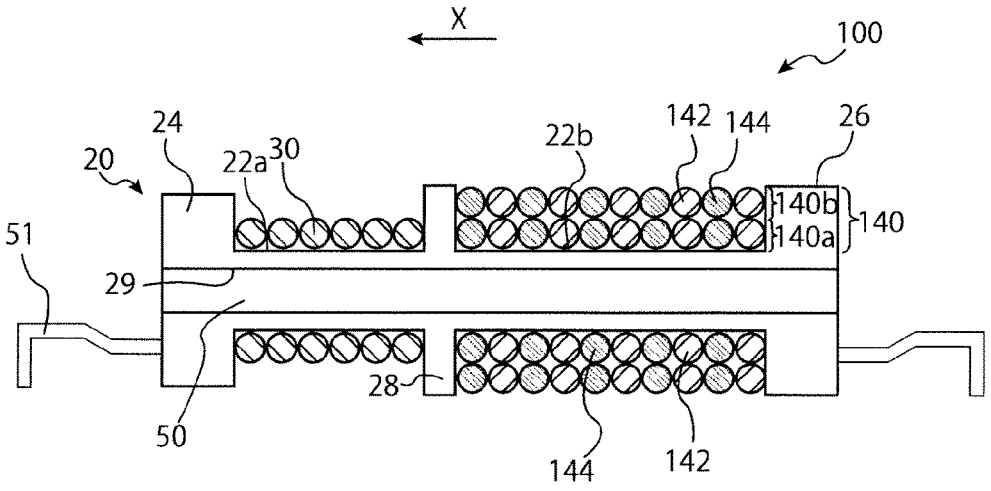
FIG. 6 is a cross section showing a coil device according to a reference example.

The coil device 10 can overcome the following problems occurred when the electric current of the second winding part 40 flows separately through the first wire part 42 and the second wire part 44. FIG. 6 is a cross section of a coil device 100 according to a reference example. In a second winding part 140 of the coil device 100, a second wire part 144 is located nearer to the first winding part 30 than a first wire part 142 in both an inner winding layer 140*a* and an outer winding layer 140*b*. Except for this configuration, the coil device 100 is the same as the coil device 10. The second winding part 140 of the coil device 100 is formed by winding the wire bundle 46 around the second outer peripheral surface 22*b* of the bobbin 20 without twisting the wire bundle 46 as shown by the arrows 94 in FIG. 5B.

In the coil device 100, the first wire part 142 and the second wire part 144 are arranged in the same manner in both the inner winding layer 140*a* and the outer winding layer 140*b*, and thus the second wire part 144 is arranged nearer to the first winding part 30 than the first wire part 142 even when considering the second winding part 140 as a whole. Thus, the second wire part 144 has magnetic coupling that is stronger than that of the first wire part 142, and a large electric current flows through the second wire part 144 in a biased manner. As a result, there is a problem that heat generation and energy loss are increased. Also, a circulating electric current may occur at the time of biased magnetic coupling, and in this case, there is a problem that the circulating electric current causes heat generation and energy loss.

On the other hand, in the coil device 10 shown in FIG. 1, the second wire part 44 is arranged nearer to the first winding part 30 than the first wire part 42 in the inner winding layer 40*a*, and the first wire part 42 is arranged nearer to the first winding part 30 than the second wire part 44 in the outer winding layer 40*b*. In this arrangement, the coil device 10 can adjust magnetic coupling to the first winding part 30 between the first wire part 42 and the second wire part 44. Thus, the coil device 10 can prevent a problem of flowing an electric current through one of the wire parts in a biased manner and a problem of generation of a circulating electric current, and thus prevent heat generation and energy loss caused by these problems.

In the coil device 10, the distance between the outer winding layer first wire part 42*b* and the inner winding layer second wire part 44*a* is smaller than the distance between the outer winding layer second wire part 44*b* and the inner winding layer second wire part 44*a*. In this arrangement, magnetic coupling to the first winding part 30 can be adjusted more uniformly between the first wire part 42 and the second wire part 44. Also, this arrangement is advantageous for space saving.

The prevent invention is explained above with reference to the coil device 10, but is not limited to the above-mentioned embodiment, and needless to say, includes various variations. For example, the second winding part 40 is not limited to a double-layer structure of the inner winding layer 40*a* and the outer winding layer 40*b*, but may be made by winding the first wire part 42 and the second wire part 44 are wound with three, four, or five or more layers. When forming a second winding part with three or more layers, the wire bundle 46 is preferably twisted every time a direction where the wire bundle 46 proceeds to be wound is changed (see FIG. 5B) to replace a positional relation between the first wire part 42 and the second wire part 44.

Also, the number of turns of the inner winding layer 40*a* and the outer winding layer 40*b* may be the same, or may be different in such a manner that the number of turns of the outer winding layer 40*b* is less than that of the inner winding layer 40*a*, for example.

NUMERICAL REFERENCES

10 . . . coil device
20 . . . bobbin
22 . . . outer peripheral surface
22*a* . . . first outer peripheral surface
22*b* . . . second outer peripheral surface
28 . . . partition portion
30 . . . first winding part
40 . . . second winding part
40*a* . . . inner winding layer
40*b* . . . outer winding layer
42 . . . first wire part
42*a* . . . inner winding layer first wire part
42*b* . . . outer winding layer first wire part
44 . . . second wire part
44*a* . . . inner winding layer second wire part
44*b* . . . outer winding layer second wire part
46 . . . wire bundle
X . . . winding axis direction

The invention claimed is:

1. A method for manufacturing a coil device, comprising the steps of:

preparing a bobbin whose outer peripheral surface includes a partition portion and a flange portion;

forming a first winding part only between the partition portion and the flange portion and on the outer peripheral surface of at one side of the partition portion, wherein the partition portion is integrated in the bobbin;

forming an inner winding layer of a second winding part by winding a wire bundle with a first wire part and a second wire part around the outer peripheral surface at the other side of the partition portion so that the first wire part and the second wire part are adjacent to each other in a winding axis direction; and forming an outer winding layer of the second winding part by winding the wire bundle around of the second winding part so that the first wire part and the second wire part are adjacent to each other in the winding axis direction, wherein the wire bundle is twisted to change a positional relation between the first wire part and the second wire part.

2. The method for manufacturing the coil device as set forth in claim 1, wherein the first wire part of the outer winding layer is arranged nearer to the second wire part of the inner winding layer than the second wire part of the outer winding layer.

3. The method for manufacturing the coil device as set forth in claim 2 further comprising a core arranged inside the bobbin.

4. The method for manufacturing the coil device as set forth in claim 1 further comprising a core arranged inside the bobbin.

5. A method for manufacturing a coil device, comprising the steps of:

preparing a bobbin whose outer peripheral surface includes a partition portion;

forming a first winding part on the outer peripheral surface at one side of the partition portion;

forming an inner winding layer of a second winding part by winding a wire bundle with a first wire part and a second wire part around the outer peripheral surface at the other side of the partition portion so that the first wire part and the second wire part are adjacent to each other in a winding axis direction, and forming an outer winding layer of the second winding part by winding the wire bundle around an outside of the inner winding layer so that the first wire part and the second wire part are adjacent to each other in the winding axis direction, wherein the wire bundle is twisted to change a positional relation between the first wire part and the second wire part.

* * * * *